US005698945A

United States Patent [19]

Ikedo et al.

[11] Patent Number: 5,698,945

[45] **Date of Patent: *Dec. 16, 1997**

[54] DEUTERIUM GAS DISCHARGE TUBE

[75] Inventors: Tomoyuki Ikedo; Yoshinobu Ito; Ryotaro Matui, all of Hamamatsu, Japan

[73] Assignee: Hamamatsu Photonics K.K., Hamamatsu, Japan

[ * ] Notice: The term of this patent shall not extend beyond the expiration date of Pat. No. 5,552,669.

[21] Appl. No.: 552,063

[22] Filed: Nov. 2, 1995

[30] Foreign Application Priority Data

Feb. 17, 1995 [JP] Japan ..... 7-029580

[51] Int. Cl.[6] ..... H01J 17/04; H01J 61/10

[52] U.S. Cl. ..... 313/613; 313/112; 313/292; 313/581

[58] Field of Search ..... 313/112, 117, 313/243, 292, 581, 589, 590, 613, 622, 614

[56] References Cited

U.S. PATENT DOCUMENTS 2,279,831 4/1942 Lempert et al. ..... 313/292
2,916,646 12/1959 Rohrer ..... 313/117
3,956,655 5/1976 Peve ..... 313/112
4,016,445 4/1977 Cassidy et al. ..... 313/637
5,552,669 9/1996 Ikedo et al. ..... 313/613

FOREIGN PATENT DOCUMENTS 4-255662 9/1992 Japan ..... H01J 61/68

*Primary Examiner*—Michael Horabik
*Assistant Examiner*—Michael Day
*Attorney, Agent, or Firm*—Cushman Darby & Cushman IP Group of Pillsbury Madison & Sutro LLP

[57] ABSTRACT

A gas discharge tube includes a first spacer, a second spacer, an anode support member, and an anode. The first spacer is arranged to contact the rear surface of the focusing electrode support member and the front surface of the anode, and the second spacer is arranged to contact the front surface of the anode support member and the rear surface of the anode. This arrangement clamps the anode between the first and second spacers to hold the anode securely between the rear surface of the focusing support member and the front surface of the anode support member, keeping the distance between the focusing electrode and the anode constant. This structure improves the service life and the operational stability of the gas discharge tube during continuous light emission over an extended period of time.

22 Claims, 10 Drawing Sheets

DEUTERIUM GAS DISCHARGE TUBE

BACKGROUND OF THE INVENTION

1. Field of the Invention

The present invention relates to a gas discharge tube used as an ultraviolet light source for a spectrophotometer, liquid chromatography, or the like.

2. Related Background Art

A gas discharge tube is a discharge light source using positive column light emission by arc discharge of a gas sealed in a tube. A typical known gas discharge tube is a deuterium discharge tube in which ultraviolet light emitted by discharge of sealed deuterium is. This deuterium discharge tube is mainly used as an ultraviolet continuous spectrum source for a spectrophotometer or the like. Note that such a deuterium discharge tube is described in, e.g., Japanese Patent Application Laid-Open Gazette No. 4-255662.

SUMMARY OF THE INVENTION

In such a gas discharge tube, since very small variations of, e.g., 0.01% or 0.001% in the output is undesirable during long-time continuous light emission, strict characteristics are requested in many cases. Further, it is necessary to maintain the electrical insulating property between the focusing electrode and anode of the gas discharge tube during long-time continuous light emission.

It is an object of the present invention to provide a gas discharge tube which has a longer service life than the conventional gas discharge tube and is capable of improving the operational stability during long-time continuous light emission. It is further an object of the present invention to provide a gas discharge tube which can fully prevent a short circuit between the focusing electrode and the anode of the discharge tube.

A gas discharge tube of the present invention comprises:

an envelope (vessel) for sealing a gas such as deuterium therein;

lead pins introduced into an inner space of the envelope from external of the envelope; and a light-emitting assembly (light-emitting section) positioned at distal ends of the lead pins and supported by the lead pins while spaced from an inner side wall of the envelope, the light-emitting assembly including:

a focusing electrode support member made of an insulator such as a ceramic, the focusing electrode support member having a front surface and a rear surface opposite to the front surface, the rear surface communicated with the front surface by a through hole;

a hot cathode for emitting thermoelectrons, the hot cathode being located at the front surface side of the focusing electrode support member, and being connected to and supported by at least one of the lead pins;

an anode for receiving the thermoelectrons emitted from the hot cathode, the anode being located at the rear surface side of the focusing electrode support member, facing an opening of the through hole, and being connected to and supported by another one of the lead pins;

a focusing electrode being supported by the focusing electrode support member, the focusing electrode having a focusing opening which is located at a position of an opening of the through hole for converging paths of the thermoelectrons, and being connected to and supported by another one of the lead pins;

a spacer made of an insulator such as a ceramic or a conductive material such as a metal, the spacer arranged between the focusing electrode support member and the anode and in contact with both the rear surface of the focusing electrode support member and a front surface of the anode; and an anode support member of an insulator such as a ceramic, the anode support member being located on an opposite side to the focusing electrode support member through the anode, and having a surface which is in contact with a rear surface of the anode for pushing the anode onto the rear surface of the focusing electrode support member by the spacer, whereby an interval between the focusing electrode and the anode is defined by the focusing electrode support member and the spacer.

The anode support member will have a depression at its surface facing to the focusing electrode support member, for accommodating the anode and the spacer, and the depression extends from the surface of the anode support member in a vertical direction with respect to the rear surface of the focusing electrode support member.

Further, the gas discharge tube will comprise:

a discharge straightening plate for discharge shielding, the discharge straightening plate being positioned and mounted on the front surface of the focusing electrode support member, and having a slit for passing through thermoelectrons emitted from the hot cathode; and a front cover for discharge shielding, the front cover being positioned and mounted on the front surface of the focusing electrode support member to accommodate the hot cathode and the discharge straightening plate in a space defined by the front cover and the focusing electrode support member, the front cover having a window located at a position which faces to the focusing opening of the focusing electrode, for outputting light caused by discharge.

In the gas discharge tube of the present invention, the interval between the focusing electrode and the anode is defined by a surface of the spacer, the rear surface of the focusing electrode support member and an inner wall surface of the focusing electrode support member, the inner wall surface defining the through hole.

The focusing electrode support member, the anode support member and the spacer according to the present invention are preferably made of a ceramic. Further, the focusing electrode support member and the anode support member may be made of a ceramic, while the spacer may be made of a metal.

In such a gas discharge tube, when an arc discharge occurs among the hot cathode, the focusing electrode and the anode, the anode generates heat upon reception of thermoelectrons, and the focusing electrode also generates heat upon bombardment of cations. However, in the gas discharge tube of the present invention, the anode is pressed against and fixed to the anode support member by the focusing electrode support member by the spacer, and the focusing electrode is supported on the front surface of the focusing electrode support member. For this reason, a predetermined interval between the focusing electrode and the anode can be strictly defined by the focusing electrode support member and the spacer.

Therefore, even when the focusing electrode and the anode are heated during use of the gas discharge tube as mentioned above, the predetermined distance between the focusing electrode and the anode can be kept constant to prevent deformation of the path of the thermoelectrons between the focusing electrode and the anode. Thus the arc discharge state can be held stable, and the stability of light emission of the discharge tube will not be impaired. Additionally, the present invention prevents shortening of the service life of the discharge tube caused by an increase in loss of the anode, and the like.

Further, in the gas discharge tube of the present invention, at least the focusing electrode support member and the anode support member have electrical insulating properties. For this reason, the conductive anode can be electrically insulated from the conductive focusing electrode by the conductive focusing electrode support member and the anode support member which having electrical insulating properties.

The anode according to the present invention preferably comprises:

an anode fixing plate of a conductive material, the anode fixing plate having a front surface being in contact with the spacer, and a rear surface being in contact with the anode support member; and an anode plate for receiving the thermoelectrons, the anode plate being made of a high melting point metal such as molybdenum, and being fixed on the front surface of the anode fixing plate.

In the anode containing the anode plate and the anode fixing plate, it is preferable that a part of the front surface of the anode fixing plate is not covered with the anode plate to contact the anode fixing plate with the spacer, and the anode plate (which is not in contact with the spacer) forms a space defined by a surface of the spacer, a front surface of the anode fixing plate and a surface of the anode plate.

Further, the spacer according to the present invention preferably has a shape which enables the formation a depression defined by a surface of the spacer and the rear surface of the focusing electrode support member and a depression defined by the surface of the spacer and the front surface of the anode.

Specifically, it is preferable that the spacer has a columnar shape, a prismatic shape such as a hexagonal or octagonal one, a spherical shape, or a block-like shape.

In the depression defined by the surfaces of the spacer and the focusing electrode support member and the depression defined by the surfaces of the spacer and the anode, an electrode material which would be sputtered from the anode and/or the focusing electrode by thermoelectrons during light emission of the gas discharge tube is prevented from depositing. Particularly, such an electrode material is prevented from depositing into a space defined by a surfaces of the spacer, the anode fixing plate and the anode plate.

Therefore, in the gas discharge tube of the present invention, a short circuit between the focusing electrode and the anode can be fully prevented. Further, since the above relatively complex structure for preventing the deposition of the sputtered material is formed by the spacer and the focusing electrode support member, both of which have relatively simple structures, the present invention in the gas discharge tube can not only prevent the short circuit but also be easy to produce.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

DETAILED DESCRIPTION OF THE PREFERRED EMBODIMENTS

The arrangement and function of a gas discharge tube according to the first embodiment of the present invention will be described below in detail with reference to FIGS. 1 to 6. The gas discharge tube of this embodiment is a side-on type deuterium discharge tube which emits light (ultraviolet light) from the side portion of the tube. Note that, in this embodiment, the front and rear sides are defined on the basis of the light emission direction.

Figure 1:
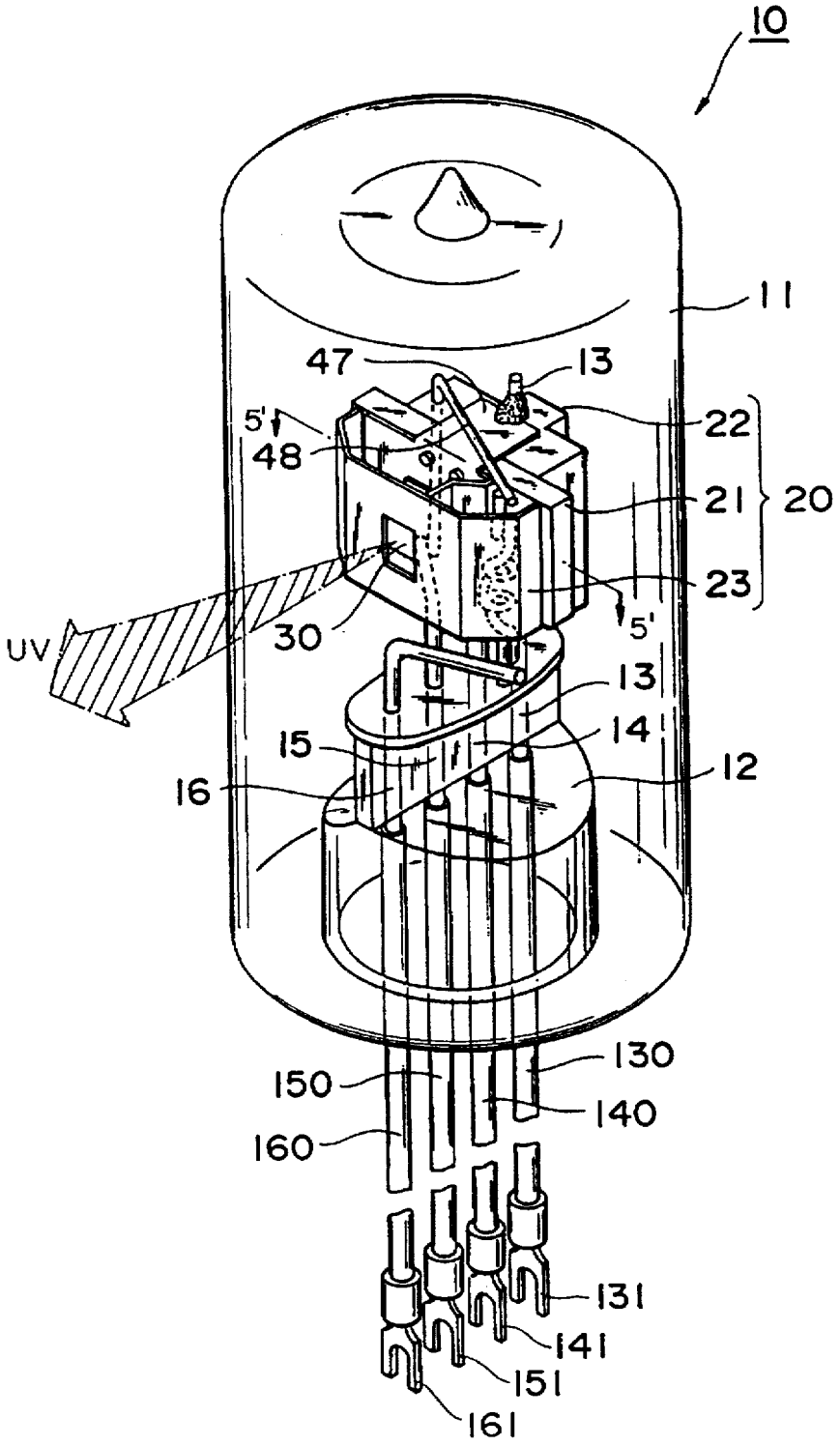
FIG. 1 is a perspective view showing an embodiment (first embodiment) of a side-on type gas discharge tube according to the present invention.

In a deuterium discharge tube 10 shown in FIG. 1, a light-emitting assembly (light-emitting section) 20 is accommodated in a cylindrical glass envelope 11 while being supported by lead pins 13 to 16. Deuterium gas is sealed in the glass envelope 11 at about several Torr. The envelope 11, with its head portion sealed, has a cylindrical shape, and the bottom portion of the envelope 11 is hermetically sealed by a glass stem 12. The envelope 11 is made of ultraviolet light-transmitting glass, quartz glass or the like which has a high permeability to ultraviolet light.

The four lead pins 13 to 16 which lie parallel alignment with each other, extend through the glass stem 12 from the exterior of the envelope 11 and are covered by insulating members 130, 140, 150, and 160, respectively. Terminals 131, 141, 151, and 161 will be connected to terminals of an external power supply. The light-emitting assembly 20 is positioned at distal ends of the lead pins 13–16 and is spaced from an inner side wall of the envelope 11. The light-emitting assembly 20 comprises a front cover 23 which is made of a metal such as Ni or SUS, or a ceramic; an anode support member 22 which is made of a ceramic; and a focusing electrode support member 21 arranged between the anode support member 22 and the front cover 23 and made of a ceramic.

Figure 2:
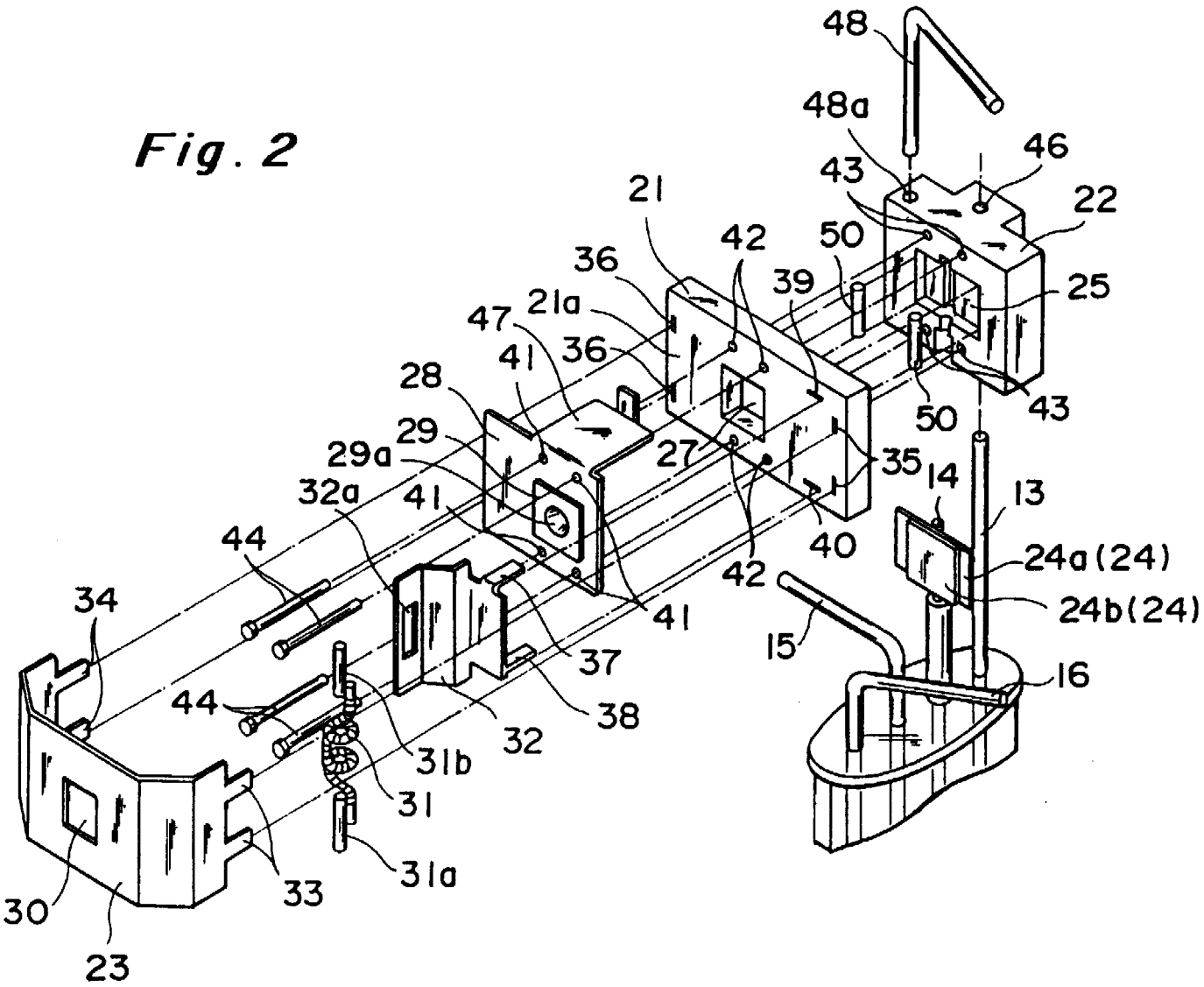
FIG. 2 is an exploded perspective view of a light-emitting assembly of the gas discharge tube shown in FIG. 1.

Specifically, the light-emitting assembly 20, as shown in FIG. 2, comprises: a hot cathode 31 for emitting thermoelectrons; an anode 24 for receiving the thermoelectrons emitted from the hot cathode 31; a focusing electrode 29 having a focusing opening 29*a* for converging and passing the thermoelectrons through; a focusing electrode support member (discharge shielding member) 21 for supporting the focusing electrode 29; two columnar spacers 50 located between the focusing electrode support member 21 and the anode 24; and an anode support member 22 located on the opposite side of the anode 24 opposite the focusing electrode support member 21 in order to push the anode 24 onto the focusing electrode support member 21 against the spacers 50. The light-emitting assembly 20 further comprises: a discharge straightening plate 32 mounted on the front surface 21*a* of the focusing electrode support member 21 and having a slit 32*a* for passing the thermoelectrons emitted from the hot cathode 31 through; and a front cover 23 mounted on the front surface 21*a* of the focusing electrode support member 21 and having a window 30 for outputting ultraviolet light (UV) caused by arc discharge.

The structure of the light-emitting assembly 20 will be described below in detail.

Figure 3:
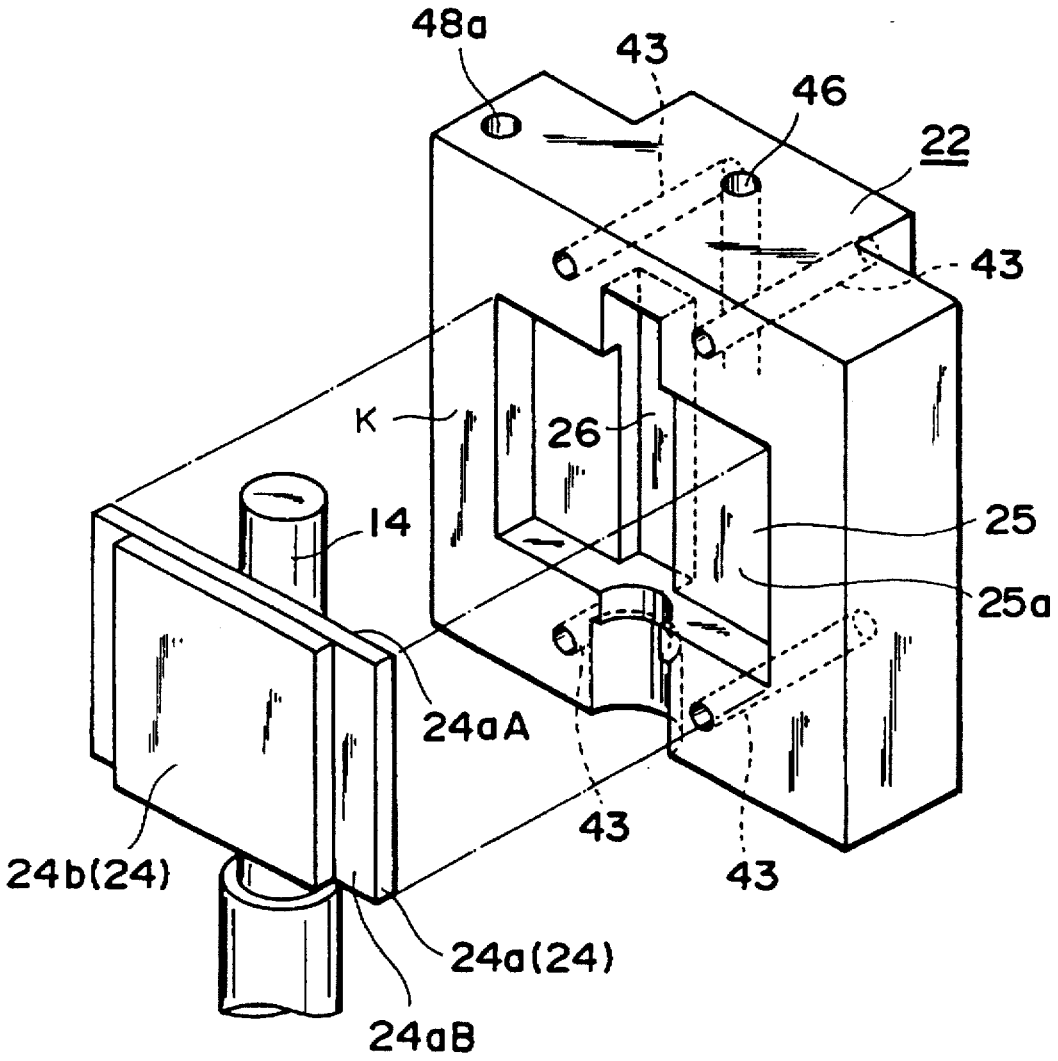
FIG. 3 is a perspective view showing a focusing electrode support member and an anode in the light-emitting assembly shown in FIG. 2.
Figure 5:
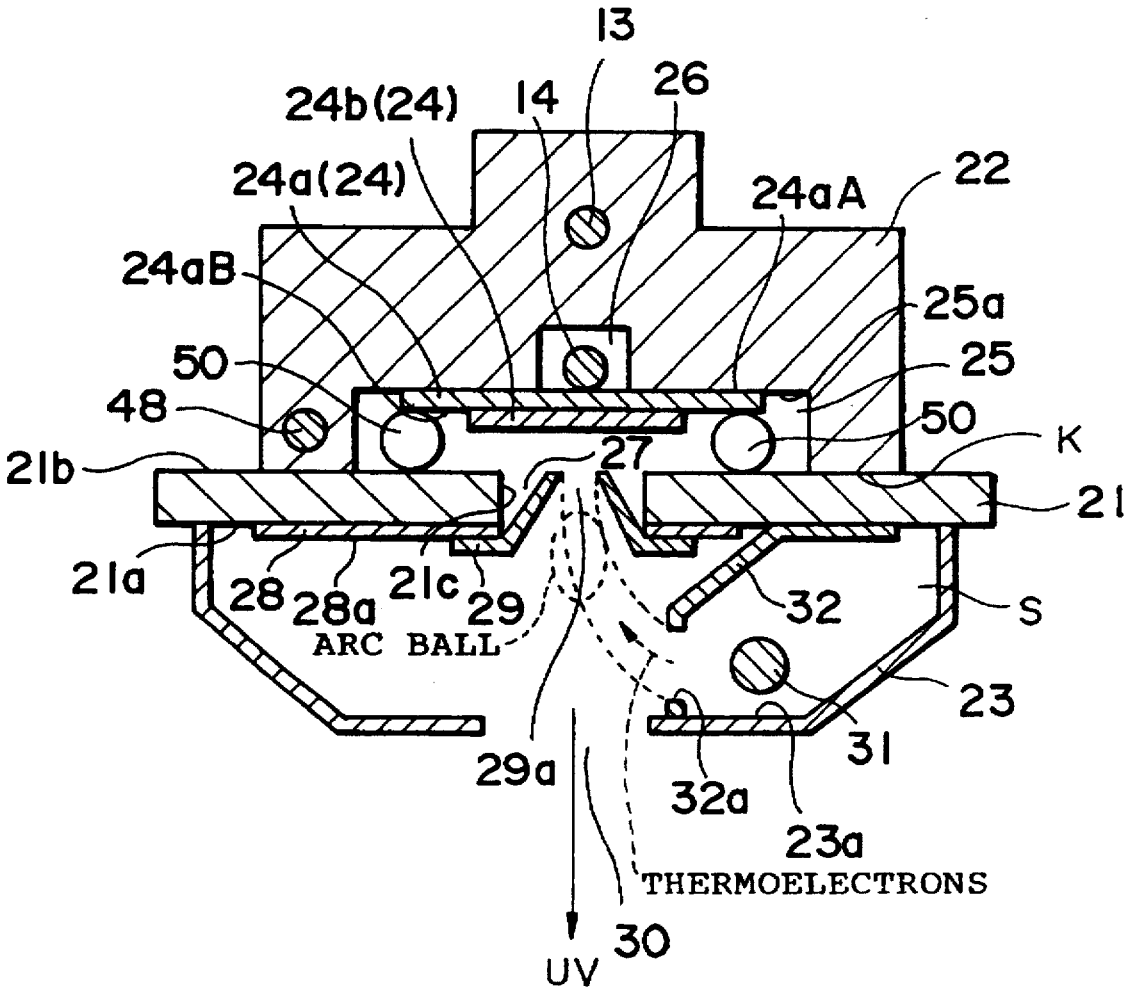
FIG. 5 is a horizontal sectional view of the light-emitting assembly of the gas discharge tube shown in FIG. 1 (taken along a line A—A in FIG. 1).

As shown in FIGS. 2, 3 and 5, an anode (anode portion) 24 is fixed at the distal end of the lead pin 14. This anode 24 is constructed with a rectangular anode fixing plate 24*a* made of a metal such as Ni fixed at the distal end of the lead pin 14 and a plate-like anode (anode plate) 24*b* fixed on a front surface 24*a*B of the anode fixing plate 24*a*. A part of the front surface 24*a*B of the anode fixing plate 24*a* is not covered with the anode plate 24*a*. The anode plate 24*b* is made of a high melting point metal such as molybdenum or tungsten. In this specification, the high melting point metal means one of a group of materials having a melting point higher than that (1414° C.) of silicon.

Further, the anode support member 22 contains a prism having an almost convex section and has, at its front portion, an anode accommodation recess portion (depression) 25 for accommodating the anode fixing plate 24*a*, and a lead pin accommodation recess portion (depression) 26 for accommodating the distal end portion of the lead pin 14 located behind the anode 24. Therefore, when the lead pin 14 is accommodated in the lead pin accommodation recess portion 26 while fixing the anode 24 to the lead pin 14, the anode support member 22 can be held in the envelope 11 by the lead pin 14. A rear surface 24*a*A of the anode fixing plate 24*a* is in contact with and supported by a bottom surface 25*a* (constituting a part of a front surface K of the anode support member 22) of the anode accommodation recess portion 25.

The anode support member 22 is integrally formed of a ceramic having electrical insulating properties and a high thermal conductivity. A so-called conductive ceramic such as beryllium oxide or aluminum nitride is preferably used. Therefore, the anode support member 22 acts as a heat sink for the anode 24 to be heated to a high temperature, thereby efficiently dissipating the heat accumulated in the light-emitting assembly 20.

Figure 4:
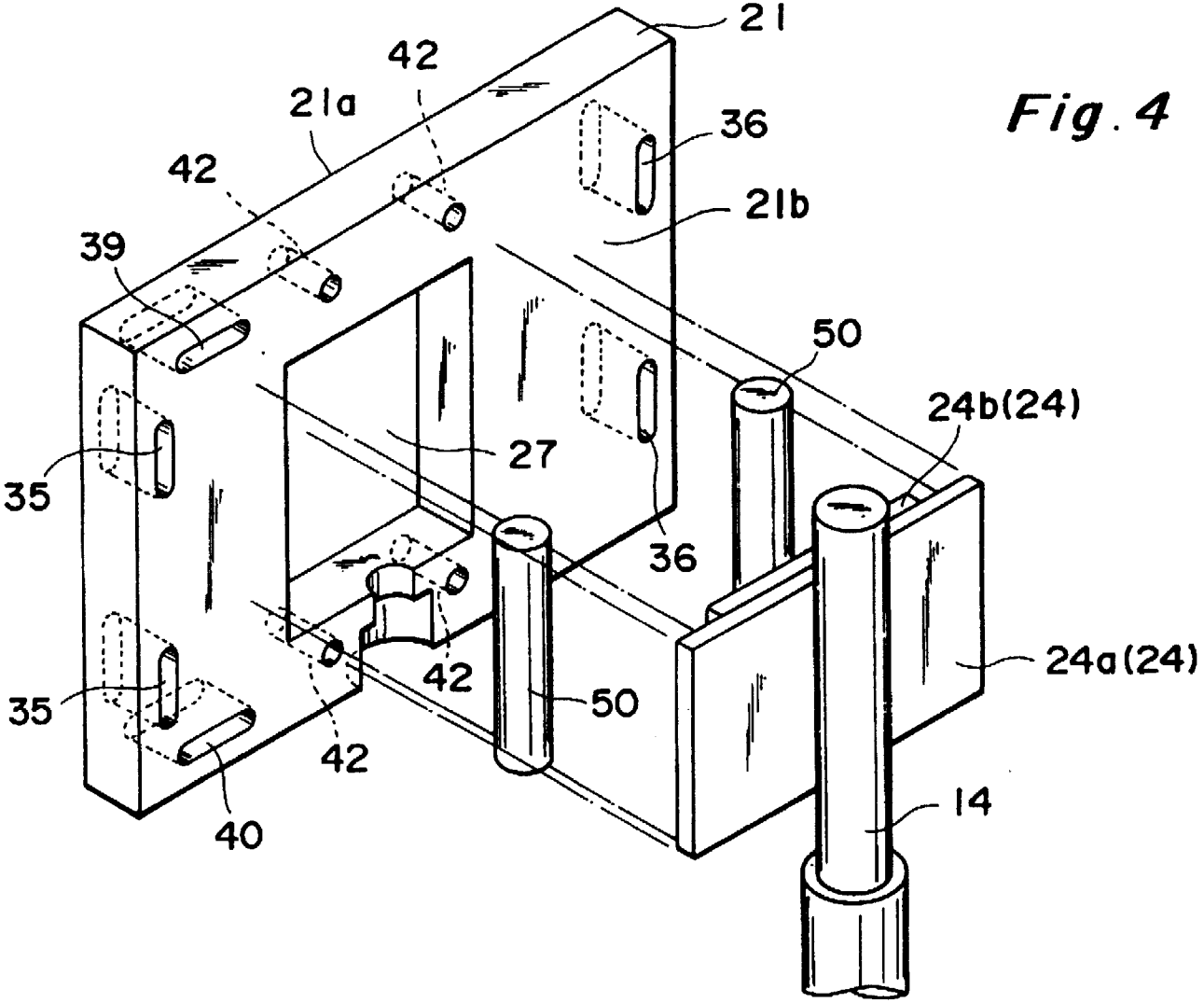
FIG. 4 is a perspective view showing an anode support member and the anode in the light-emitting assembly shown in FIG. 2.

As shown in FIGS. 2, 4, and 5, the plate-like focusing electrode support member 21 arranged in front of the anode portion 24 is made of a ceramic having electrical insulating properties and a high thermal conductivity. The focusing electrode support member 21 has a rectangular opening portion (through hole) 27 at a position facing the anode plate 24*b*. A focusing electrode fixing plate 28 made of a metal is arranged to contact the focusing electrode support member 21. A focusing electrode 29 made of a metal is fixed to a front surface 28*a* of the focusing electrode fixing plate 28. The focusing electrode fixing plate 28 is fixed to a front surface 21*a* of the focusing electrode support member 21. A focusing opening 29*a* of the focusing electrode 29 is arranged in the opening portion (through hole) 27 of the focusing electrode support member 21 and opposes the anode plate 24*b*.

Further, two columnar spacers 50 made of a ceramic are arranged between the focusing electrode support member 21 and the anode 24, and are each in contact with both the rear surface 2*b* of the focusing electrode support member 21 and a front surface 24*a*B of the anode fixing plate 24*a*.

Therefore, as shown in FIG. 5, the interval between the focusing electrode 29 and the anode 24 is defined by the focusing electrode support member 21 and the spacers 50. Specifically, the interval is defined by a surface 50*a* of the spacer 50, the rear surface 2l*b* of the focusing electrode support member 21 and an inner wall surface 21*c* of the focusing electrode support member 21, the inner wall surface 21*c* defining the through hole 27.

Figure 6:
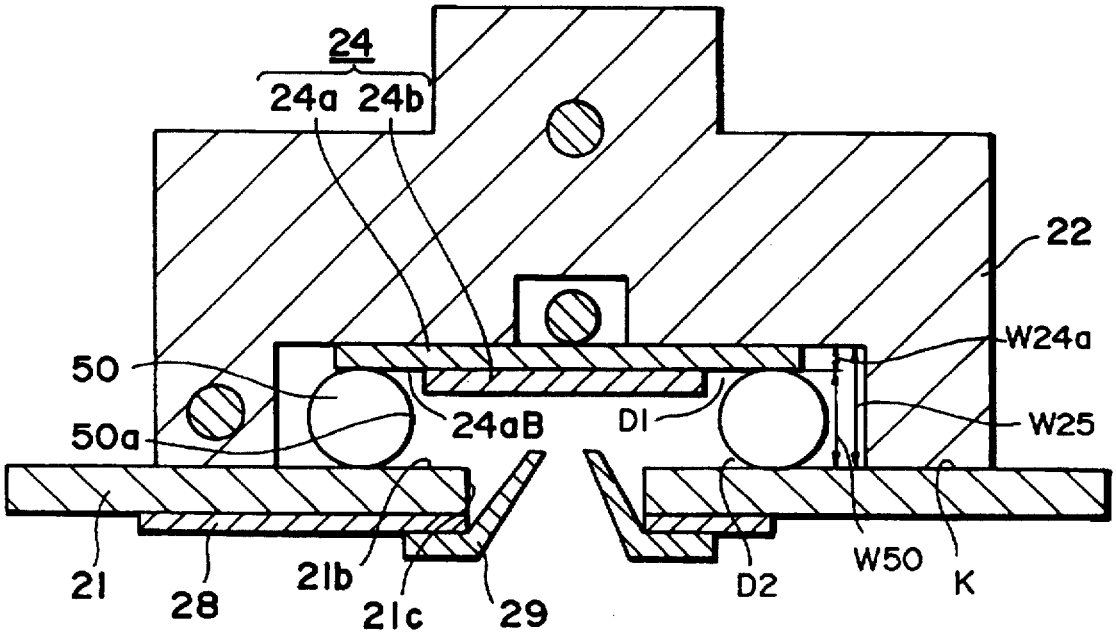
FIG. 6 is a partial sectional view for explaining a structure of the anode accommodation recess portion in the light-emitting assembly shown in FIG. 5.

As shown in FIG. 6, since the spacers 50 have a columnar shape and the anode plate 24*b* is not in contact with the spacers 50, spaces (depressions) D1, each defined by the surface 50*a* of the spacer 50, the front surface 24*a*B of the anode fixing plate 24*a* and the surface of the anode plate 24*b*, are formed. Further, spaces (depressions) D2, each defined by the surface 50*a* of the spacer 50 and the rear surface 21*b* of the focusing electrode support member 21, are also formed.

The anode accommodation recess portion 25 of the anode support member 22, as shown in FIG. 6, has a depth W25 matching a sum of a diameter W50 of the spacer 50 and a thickness W24*a* of the anode fixing plate 24*a*, allowing an edge of the front surface K of the anode support member 22 to directly contact the rear surface 2l*b* of the focusing electrode support member 21.

As shown in FIGS. 2 and 5, the front cover 23 has an almost U-shaped section and is fixed to the front surface 21*a* of the focusing electrode support member 21. A window 30 for passing through light caused by discharge is formed around the center portion of the front cover 23 so that the window 30 is opposite the focusing opening 29*a* and the anode plate 24*b*. A spiral hot cathode (filament) 31 for generating thermoelectrons is arranged in a space S formed between the front cover 23 and the focusing electrode support member 21. The hot cathode 31 is arranged outside the optical path of the ultraviolet light to be emitted, i.e., on one side in the front cover 23. The hot cathode 31 has electrode rods 31*a* and 31*b* at its two ends.

A discharge straightening plate 32 made of a metal (Ni or SUS) or a ceramic is arranged outside the optical path of the ultraviolet light to be emitted and between the hot cathode 31 and the focusing electrode 29. One end of the discharge straightening plate 32 is fixed to the front surface 21*a* of the focusing electrode support member 21 while the other end is in contact with an inner wall 23*a* of the front cover 23. The discharge straightening plate 32 also has a slit 32*a* for causing the hot cathode 31 to communicate with the focusing electrode 29. Thermoelectrons generated from the hot cathode 31 are passed through the slit 32*a* to be straightened.

Assembling of the light-emitting assembly 20 will be described below.

In a case where the front cover 23 and the discharge straightening plate 32 are made of a metal, as shown in FIG. 2, pairs of left and right bendable pawl pieces 33 and 34 are integrally formed at the two ends of the metal front cover 23. Pawl through holes 35 and 36 (shown in FIG. 4) for receiving the pawl pieces 33 and 34, respectively, are formed in the focusing electrode support member 21 at its two ends. Therefore, when the distal ends of the pawl pieces 33 and 34 are respectively inserted into the pawl through holes 35 and 36 and then bent, the front cover 23 can be properly fixed to the focusing electrode support member 21. In addition, a pair of upper and lower pawl pieces 37 and 38 are integrally formed at the end portions of the metal discharge straightening plate 32. Pawl through holes 39 and 40 (shown in FIG. 4) for receiving the pawl pieces 37 and 38 are formed in the focusing electrode support member 21 at its upper and lower ends. Therefore, when the distal ends of the pawl pieces 37 and 38 are respectively inserted into the pawl through holes 39 and 40 and then bent, the discharge straightening plate 32 can be properly fixed to the focusing electrode support member 21.

On the other hand, in a case where the front cover 23 and the discharge straightening plate 32 are made of a ceramic, the above-described pawl pieces 33, 34, 37, and 38 are not arranged. The front cover 23 and the discharge straightening plate 32 are directly fixed to the focusing electrode support member 21 by using rivets or the like.

As shown in FIGS. 2 to 4, rivet through holes 41, 42 and 43 are formed in the focusing electrode fixing plate 28, the focusing electrode support member 21 and the anode support member 22, respectively. The rivet through holes 41 to 43 extend coaxially in the direction of assembly. Therefore, when the rivet through holes 41 to 43 are positioned, rivets 44 are inserted into the rivet through holes 41 to 43, and the end portions of the rivets 44 are caulked, integrally assembling the focusing electrode fixing plate 28, the focusing electrode support member 21 and the anode support member 22 as shown in FIG. 5.

A vertical through hole 46 for receiving the lead pin 13 is formed in the anode support member 22 at its rear portion. The distal end of the lead pin 13 inserted in this vertical through hole 46 is welded to a tongue piece 47 integrally formed at the head portion of the focusing electrode fixing plate 28 (shown in FIG. 1). A vertical through hole **48*a* for receiving an L-shaped electrode rod 48 is formed in the anode support member 22 at its side portion. To fix the hot cathode 31 in the space S, the electrode rod 48 is inserted into the vertical through hole 48*a*, and thereafter, the lower end of the electrode rod 48 is welded to the distal end of the lead pin 15. Additionally, the electrode rod 31*b* of the hot cathode 31 is welded to the distal end of the electrode rod 48 while the electrode rod 31*a* of the hot cathode 31 is welded to the distal end of the lead pin 16**.

As shown in FIGS. 4, 5 and 6, two columnar spacers 50 made of a ceramic are arranged between the focusing electrode support member 21 and the anode fixing plate **24*a* of the anode 24. The spacers 50 are each in contact with the rear surface 21*b* of the focusing electrode support member 21 and the front surface 24*a*B of the anode fixing plate 24*a* on both sides in the anode accommodation recess portion 25. When the focusing electrode support member 21 and the anode support member 22 are assembled through the rivets 44, the rear surface 24*a*A of the anode fixing plate 24*a* of the anode 24 is pressed against and fixed to, by the pressing force the spacers 50, the bottom surface 25*a* of the anode accommodation recess portion 25 constituting a part of the front surface K of the anode support member 22. Therefore, a predetermined interval between the focusing electrode 29 and the anode 24 can always be kept constant by the spacers 50 and the focusing electrode support member 21**.

Figure 7:
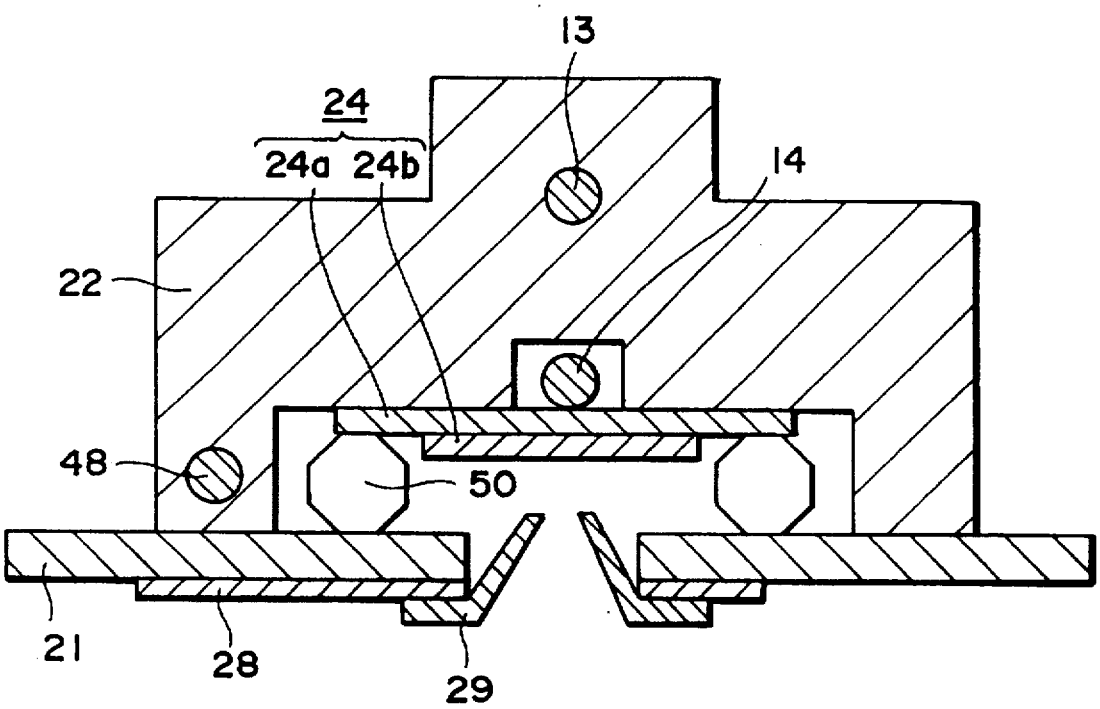
FIG. 7 is a partial sectional view of another embodiment of the light-emitting assembly according to the present invention.

Although ceramic spacers are used in the embodiment mentioned above, spacers made of a metal such as Ni or SUS may be used as spacers 50. Further, spacers 50 may have a spherical, prismatic, or block-like shape. FIG. 7 shows another embodiment using therein octagonal prismatic spacers 50.

Next, the operation of the above-described side-on type deuterium discharge tube 10 will be described below.

A power of about 10 W is supplied from the external power supply (not shown) to the hot cathode 31 about 20 seconds before discharge to preheat the hot cathode 31. Thereafter, a DC open-circuit voltage of about 150 V is applied between the hot cathode 31 and the anode 24, thereby preparing for arc discharge.

Upon completion of the above preparation, a trigger voltage of about 350 to 500 V is applied between the hot cathode 31 and the anode 24. Under this condition, thermoelectrons emitted from the hot cathode 31 pass through the elongated slit **32*a* of the discharge straightening plate 32 toward the anode plate 24*b* while being converged by the focusing opening 29*a* of the focusing electrode 29. Arc discharge occurs in front of the focusing opening 29*a*. Ultraviolet light emitted from an arc ball (high-density discharge area) generated by this arc discharge passes through the window 30 and is then projected outward through the circumferential surface of the glass envelope 11**.

The anode 24 and the focusing electrode 29 are heated to a high temperature exceeding several hundreds °C. This heat is dissipated through the above-described members made of a ceramic or the like as needed. Since the anode 24 is firmly held by the anode support member 22 and the focusing electrode support member 21 with the spacers 50, and the focusing electrode 29 is firmly held by the focusing electrode support member 21, deformation of the above members is prevented even in a high temperature state during long-time continuous light emission. Therefore, a satisfactory positional precision between the anode 24 and the focusing electrode 29 can be kept constant.

Further, an electrode material sputtered from the anode plate **24*b* by thermoelectrons during light emission of the gas discharge tube is prevented from depositing into the depressions D1 as well as the depressions D2. Therefore, a short circuit between the focusing electrode 29 and the anode 24** can be fully prevented.

A gas discharge tube according to the second embodiment of the present invention will be described below. The gas discharge tube of this embodiment is a head-on type deuterium discharge tube which emits light from the head portion of the tube. Note that, in this embodiment, the front and rear sides are defined on the basis of the light emission direction.

Figure 8:
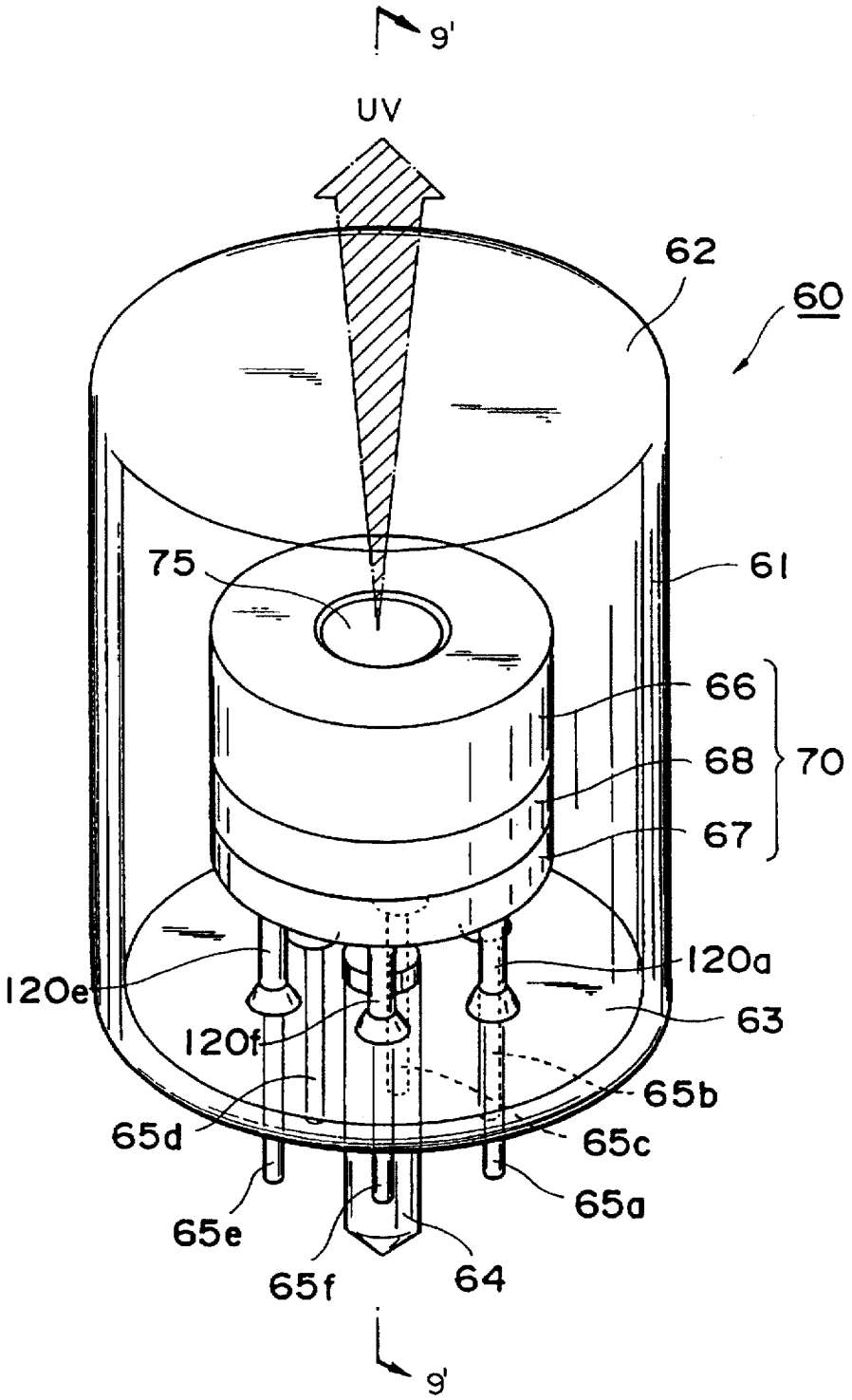
FIG. 8 is a perspective view showing an embodiment (second embodiment) of a head-on type gas discharge tube according to the present invention.

In a deuterium discharge tube 60 shown in FIG. 8, a light-emitting assembly 70 is accommodated in a cylindrical glass envelope 61. Deuterium gas (not shown) is sealed in the envelope 61 at about several Torr. The envelope 61 has a disk-like light-emitting surface 62 at the head portion and a disk-like stem 63 at the bottom portion. A tip tube 64 for exhausting/sealing a gas is provided to the stem 63. Upon completion of exhausting and then sealing of a gas in the envelope 61 through the tip tube 64, the tip tube 64 can be closed to hermetically seal the envelope 61. The envelope 61 is formed of an ultraviolet light-transmitting glass or quartz glass having a high transmissivity to ultraviolet light.

Six lead pins 65*a* to 65*f* are fixed to the stem 63. The lead pins 65*a* to 65*f* extend through the stem 63 and are connected to an external power supply (not shown) while being covered with insulating members 120*a* to 120*f*, respectively (in FIG. 8, the insulating members 120*b* to 120*d* are hidden by the light-emitting assembly 70). The light-emitting assembly 70 has a front cover 66 arranged in the front and made of a metal (Ni or SUS) or a ceramic; an anode support member 67 arranged at the rear of the front cover 66 and made of a ceramic; and a focusing electrode support member 68 fixed between the anode support member 67 and the front cover 66 and made of a ceramic.

The structure of the light-emitting assembly 70 will be described below in detail.

Figure 9:
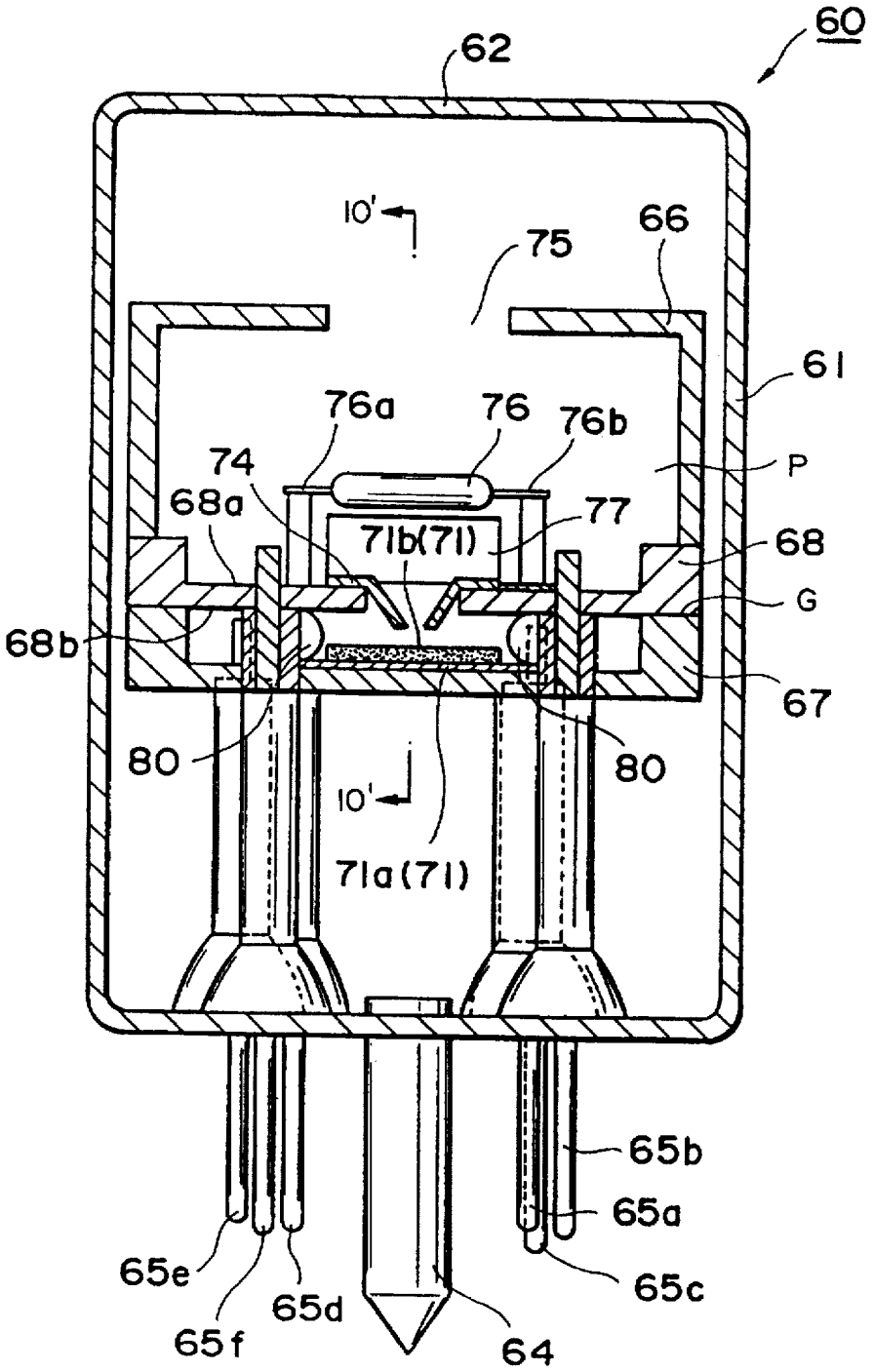
FIG. 9 is a vertical sectional view of the gas discharge tube shown in FIG. 8 (taken along a line B—B in FIG. 8).
Figure 10:
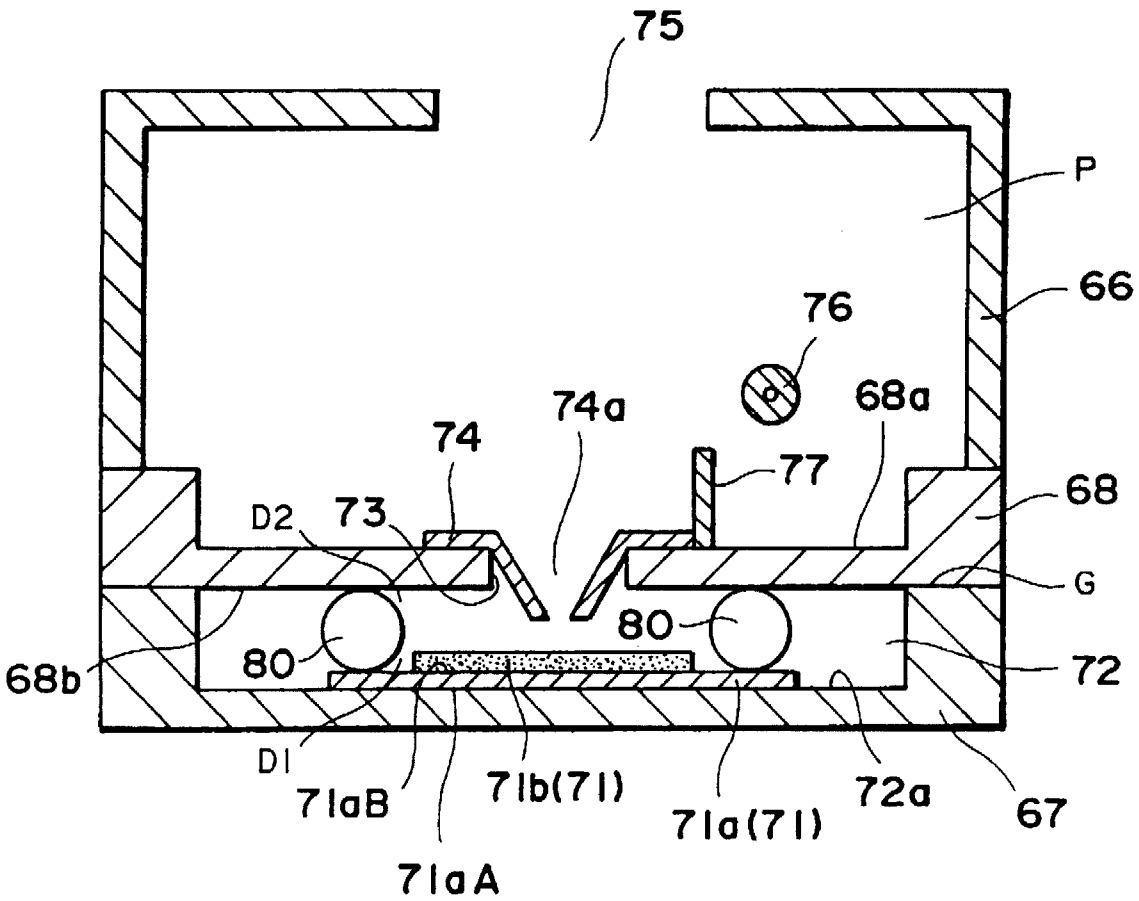
FIG. 10 is a vertical sectional view of a light-emitting assembly of the gas discharge tube shown in FIG. 8 (taken along a line C—C in FIG. 9).

As shown in FIGS. 9 and 10, an anode 71 is fixed at the distal end of the lead pin 65*c* extending through the anode support member 67. This anode 71 is constituted by a rectangular anode fixing plate 71*a* fixed at the distal end of the lead pin 65*c*, and a plate-like anode (anode plate) 71*b* fixed on a front surface 71*a*B of the anode fixing plate 71*a*. A circumferential portion of the front surface 71*a*B of the anode fixing plate 71*a* is not covered with the anode plate 71*b*. The anode fixing plate 71*a* is made of a metal such as Ni, and the anode plate 71*b* is made of a high melting point metal such as molybdenum or tungsten.

The cylindrical anode support member 67 having an almost concave section has, at its front portion, an anode accommodation recess portion 72 for accommodating the anode 71. Therefore, a rear surface 71*a*A of the anode fixing plate 71*a* can be brought into contact with and supported by a bottom surface 72*a* (constituting a part of a front surface G of the anode support member 67) of the anode accommodation recess portion 72. To arrange the anode support member 67 in the envelope 61, the anode support member 67 is fixed at the distal end of the lead pin 65*f*.

The plate-like focusing electrode support member 68 arranged in front of the anode 71 is made of a ceramic having electrical insulating properties and a high thermal conductivity. The focusing electrode support member 68 has a rectangular opening portion (through hole) 73 at a position opposite the anode plate 71*b*. A metal focusing electrode 74 is fixed to a front surface 68*a* of the focusing electrode support member 68. A focusing opening 74*a* of the focusing electrode 74 is arranged in the opening portion 73 of the focusing electrode support member 68 and is opposite to the anode plate 71*b*. In addition, the focusing electrode 74 is welded to the distal end of the lead pin 65*a* extending through the anode support member 67 and the focusing electrode support member 68. To arrange the focusing electrode support member 68 in the envelope 61, the focusing electrode support member 68 is fixed at the distal end of the lead pin 65*e*.

The front cover 66 has a cup-like section and is fixed to the front surface 68*a* of the focusing electrode support member 68 by rivets or pawl pieces (not shown). A window 75 for passing through light caused by discharge is formed around the center portion of the front cover 66 so that the window 75 is opposite to the focusing opening 74*a* and the anode plate 71*b*. A hot cathode 76 for generating thermoelectrons is arranged in a space P formed between the front cover 66 and the focusing electrode support member 68. The hot cathode 76 is arranged outside the optical path of the ultraviolet light to be emitted, i.e., on one side in the front cover 66. The hot cathode 76 has electrode rods 76*a* and 76*b* at its two ends. The electrode rods 76*a* and 76*b* are respectively welded to the distal ends of the lead pins 65*b* and 65*d* extending through the anode support member 67 and the focusing electrode support member 68.

A discharge straightening plate 77 made of a metal (Ni or SUS) or a ceramic is arranged outside the optical path of the ultraviolet light to be emitted and between the hot cathode 76 and the focusing electrode 74. The discharge straightening plate 77 stands on the front surface 68*a* of the focusing electrode support member 68 while contacting the focusing electrode 74.

Four spherical spacers 80 made from a ceramic are arranged between the focusing electrode support member 68 and the anode fixing plate 71*a* of the anode 71. Each of the spacers 80 are in contact with both a rear surface 68*b* of the focusing electrode support member 68 and the front surface 71*a*B of the anode fixing plate 71*a*, around the focusing opening 74*a* in the anode accommodation recess portion 72. When the focusing electrode support member 68 and the anode support member 67 are assembled and fixed, the rear surface 71*a*A of the anode fixing plate 71*a* is pressed against and fixed to, by the pressing force given by the spacers 80, the bottom surface 72*a* of the anode accommodation recess portion 72 constituting a part of the front surface G of the anode support member 67. Therefore, a predetermined interval between the focusing electrode 74 and the anode 71 can always be kept constant by the spacers 80 and the focusing electrode support member 68.

Although ceramic spacers are used in the embodiment mentioned above, spacers made of a metal such as Ni or SUS may be used as spacers 80. Further, spacers 80 may have a columnar, prismatic, or block-like shape.

Next, the operation of the above-described head-on type deuterium discharge tube 60 will be described below.

A power of about 10 W is supplied from the external power supply (not shown) to the hot cathode 76 about 20 seconds before discharge to preheat the hot cathode 76. Thereafter, a DC open-circuit voltage of about 150 V is applied between the hot cathode 76 and the anode 71, thereby preparing for arc discharge.

Upon completion of the above preparation, a trigger voltage of about 350 to 500 V is applied between the hot cathode 76 and the anode 71. Under this condition, thermoelectrons emitted from the hot cathode 76 are straightened by the discharge straightening plate 77 toward the anode plate 71*b* while being converged through the focusing opening 74*a* of the focusing electrode 74. Arc discharge occurs in front of the focusing opening 74*a*. Ultraviolet light emitted from an arc ball generated by this arc discharge passes through the window 75 and is then projected outward through the light-emitting surface 62 of the glass envelope 61.

The anode 71 and the focusing electrode 74 are heated to a high temperature exceeding several hundreds °C. This heat is dissipated by above-described members which are formed from a ceramic or the like, as needed. Since the anode 71 is firmly held by the anode support member 67 and the focusing electrode support member 68 through the spacers 80, and the focusing electrode 74 is firmly held by the focusing electrode support member 68, deformation of the above members is prevented even in a high temperature state during long-time continuous light emission. Therefore, a satisfactory positional precision between the anode 71 and the focusing electrode 74 can be kept constant.

Further, an electrode material sputtered from the anode plate 71*b* by thermoelectrons during light emission of the gas discharge tube is prevented from depositing into the depressions D1 defined by the surface of the spacer 80, the front surface 71*a*B of the anode fixing plate 71*a* and the surface of the anode plate 71*b*and the depressions D2 each defined by the surface of the spacer 80 and the rear surface 68*b* of the focusing electrode support member 68. Therefore, a short circuit between the focusing electrode 74 and the anode 71 can be fully prevented.

The gas discharge tube of the present invention is not limited to the above embodiments, and various changes and modifications can also be made.

As has been described above in detail, in the gas discharge tube according to the present invention, the spacer is brought into contact with both the rear surface of the focusing electrode support member and the front surface of the anode to press the anode against the front surface of the anode support member, thereby holding constant the interval between the focusing electrode and the anode using the spacer and the focusing electrode support member. With this arrangement, the anode is firmly held by the spacer and the anode support member. Deformation of the above members hardly occurs even in a high temperature state during long-time continuous light emission, and a satisfactory positional precision between the anode and the focusing electrode can be kept constant to prevent deformation of the path of the thermoelectrons between the focusing electrode and the anode. Thus the arc discharge state can be held stable, and the stability of light emission of the discharge tube will not be impaired. Therefore, the operational stability of the gas discharge tube can be improved, and the service life thereof can also be prolonged.

In addition, in the gas discharge tube of the present invention, since the focusing electrode support member and the anode support member are made of an insulator such as a ceramic, the electrical insulating effect between the focusing electrode and the anode, as well as the heat dissipation effect from the anode and the focusing electrode, can be promoted. In a case where the spacer is also made of an insulator such as a ceramic, the electrical insulating effect and the heat dissipation effect can be further promoted.

Further, in the gas discharge tube of the present invention, a portion such as a depression on which the sputtered electrode material is prevented from depositing can be easily formed in the space formed between the focusing electrode support member and the anode support member, by means of appropriate selection of the shape and the position of the spacer to be used. For this reason, a short circuit between the focusing electrode and the anode can be easily and fully prevented by simple selection of the shape and the position of the spacer to be used.

Therefore, a gas discharge tube having a long service life and capable of improving the operational stability during long time continuous light emission can be easy provided.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims. The basic Japanese Application No. 7-29580 (29580/1995) filed on Feb. 17, 1995 is hereby incorporated by reference.

What is claimed is:

1. A gas discharge tube comprising:

a focusing electrode support member made of an insulator, said focusing electrode support member having a front surface and a rear surface, the rear surface communicating with the front surface by a through hole;

a hot cathode for emitting thermoelectrons, said hot cathode being located at the front surface side of said focusing electrode support member;

an anode for receiving the thermoelectrons emitted from said hot cathode, said anode being located at the rear surface side of said focusing electrode support member and facing an opening of the through hole;

a focusing electrode supported by said focusing electrode support member, said focusing electrode having a focusing opening located at a position of an opening of the through hole for converging paths of the thermoelectrons;

a spacer arranged between said focusing electrode support member and one side of said anode, and in contact with both the rear surface of said focusing electrode support member and a front surface of said anode;

an insulating anode support member located opposite to said focusing electrode support member on the other side of said anode and having a surface which is in contact with a rear surface of said anode for pushing said anode onto the rear surface of said focusing electrode support member by said spacer, whereby an interval between said focusing electrode and said anode is defined by said focusing electrode support member and said spacer.

2. A gas discharge tube according to claim 1, wherein said interval between said focusing electrode and said anode is defined by a surface of said spacer, the rear surface of said focusing electrode support member and an inner wall surface of said focusing electrode support member, said inner wall surface defining said through hole.

3. A gas discharge tube according to claim 1, wherein said focusing electrode support member, said anode support member and said spacer are made of a ceramic.

4. A gas discharge tube according to claim 1, wherein said focusing electrode support member and said anode support member are made of a ceramic, and said spacer is made of a metal.

5. A gas discharge tube according to claim 1, wherein said anode comprises:

an anode fixing plate made of a conductive material, said anode fixing plate having a front surface being in contact with said spacer and a rear surface being in contact with said anode support member; and an anode plate for receiving the thermoelectrons, said anode plate being made of a high melting point metal being and being fixed on the front surface of said anode fixing plate.

6. A gas discharge tube according to claim 5, wherein a part of the front surface of said anode fixing plate is not covered with said anode plate to allow said anode fixing plate to come in contact with said spacer, and said anode plate, which does not contact said spacer, forms a space defined by a surface of said spacer, a front surface of said anode fixing plate and a surface of said anode plate.

7. A gas discharge tube according to claim 1, wherein said spacer has a shape which enables the formation of depressions defined by a surface of said spacer and the rear surface of said focusing electrode support member and depressions defined by the surface of said spacer and the front surface of said anode.

8. A gas discharge tube according to claim 1, wherein said spacer has a shape selected from the group of a columnar shape, a prismatic shape, a spherical shape and a block-like shape.

9. A gas discharge tube according to claim 1, wherein said anode support member further has a depression at its surface which faces to said focusing electrode support member, for accommodating said anode and said spacer said depression extending from the surface of said anode support member to a vertical direction with respect in the rear surface of said focusing electrode support member.

10. A gas discharge tube according to claim 1, further comprising a discharge straightening plate for discharge shielding, said discharge straightening plate positioned and mounted on the front surface of said focusing electrode support member and having a slit for passing thermoelectrons emitted from said hot cathode.

11. A gas discharge tube according to claim 1, further comprising a front cover for discharge shielding, said front cover positioned and mounted on the front surface of said focusing electrode support member to accommodate said hot cathode and said discharge straightening plate in a space defined by said front cover and said focusing electrode support member, said front cover having a window located at a position facing the focusing opening of said focusing electrode, for outputting light caused by discharge.

12. A gas discharge tube comprising:

an envelope for sealing a gas therein;

lead pins introduced into an inner space of said envelope from outside of said envelope; and a light-emitting assembly positioned at distal ends of said lead pins and supported by said lead pins while spaced from an inner side wall of said envelope, said light-emitting assembly including;

a focusing electrode support member made of a conductive material, said focusing electrode support member having a front surface and a rear surface, the rear surface communicating with the front surface by a through hole;

a hot cathode for emitting thermoelectrons, said hot cathode located at the front surface side of said focusing electrode support member and being connected to and supported by at least one of said lead pins;

an anode for receiving the thermoelectrons emitted from said hot cathode, said anode being located at the rear surface side of said focusing electrode support member facing an opening of the through hole and being connected to and supported by another one of said lead pins;

a focusing electrode supported by said focusing electrode support member, said focusing electrode having a focusing opening located at a position of an opening of the through hole for converging paths of the thermoelectrons, and being connected to and supported by still another one of said lead pins;

a spacer arranged between said focusing electrode support member and one side of said anode and being in contact with both the rear surface of said focusing electrode support member and a front surface of said anode; and an insulating anode support member located opposite to said focusing electrode support member on the other side of said anode and having a surface which is in contact with a rear surface of said anode for pushing said anode onto the rear surface of said focusing electrode support member by said spacer, whereby an interval between said focusing electrode and said anode is defined by said focusing electrode support member and said spacer.

13. A gas discharge tube according to claim 12, wherein said interval between said focusing electrode and said anode is defined by a surface of said spacer, the rear surface of said focusing electrode support member and an inner wall surface of said focusing electrode support member, said inner wall surface defining said through hole.

14. A gas discharge tube according to claim 12, wherein said focusing electrode support member, said anode support member and said spacer are made of a ceramic.

15. A gas discharge tube according to claim 12, wherein said focusing electrode support member and said anode support member are made of a ceramic, and said spacer is made of a metal.

16. A gas discharge tube according to claim 12, wherein said anode comprises:

an anode fixing plate made of a conductive material, said anode fixing plate having a front surface being in contact with said spacer and a rear surface being in contact with said anode support member; and an anode plate for receiving the thermoelectrons, said anode plate being made of a high melting point metal and fixed on the front surface of said anode fixing plate.

17. A gas discharge tube according to claim 16, wherein a part of the front surface of said anode fixing plate is not covered with said anode plate to allow said anode fixing plate to come in contact with said spacer, and said anode plate, which does not contact said spacer, forms a space defined by a surface of said spacer, a front surface of said anode fixing plate and a surface of said anode plate.

18. A gas discharge tube according to claim 12, wherein said spacer has a shape which enables the formation of depressions defined by a surface of said spacer and the rear surface of said focusing electrode support member and depressions defined by the surface of said spacer and the front surface of said anode.

19. A gas discharge tube according to claim 12, wherein said spacer has a shape selected from the group of a columnar shape, a prismatic shape, a spherical shape and a block-like shape.

20. A gas discharge tube according to claim 12, wherein said anode support member further has a depression at its surface facing to said focusing electrode support member for accommodating said anode and said spacer, said depression extending from the surface of said anode support member in a vertical direction with respect to the rear surface of said focusing electrode support member.

21. A gas discharge tube according to claim 12, further comprising a discharge straightening plate for discharge shielding, said discharge straightening plate positioned and mounted on the front surface of said focusing electrode support member and having a slit for passing thermoelectrons emitted from said hot cathode.

22. A gas discharge tube according to claim 12, further comprising a front cover for discharge shielding, said front cover positioned and mounted on the front surface of said focusing electrode support member to accommodate said hot cathode and said discharge straightening plate in a space defined by said front cover and said focusing electrode support member, said front cover having a window located at a position facing the focusing opening of said focusing electrode, for outputting light caused by discharge.

* * * * *